United States Patent [19]

Peters

[11] 4,105,535

[45] Aug. 8, 1978

[54] CONVERSION OF COAL-DERIVED LIQUIDS WITH A CRYSTALLINE ALUMINOSILICATE ZEOLITE CATALYST

[75] Inventor: Alan W. Peters, Morrestown, N.J.

[73] Assignee: Mobil Oil Corporation, New York, N.Y.

[21] Appl. No.: 775,019

[22] Filed: Mar. 7, 1977

[51] Int. Cl.[2] ..... C10G 1/04; C10G 13/02; C10G 1/08

[52] U.S. Cl. ..... 208/8; 208/10; 208/111

[58] Field of Search ..... 208/8, 10, 111

[56] References Cited

U.S. PATENT DOCUMENTS

| | | | |
|---|---|---|---|
| 3,184,401 | 5/1965 | Gorin | 208/8 |
| 3,488,279 | 1/1970 | Schulman | 208/10 |
| 3,523,886 | 8/1970 | Gorin et al. | 208/8 |
| 3,694,345 | 9/1972 | Bittner | 208/111 |
| 3,702,886 | 11/1972 | Argamer et al. | 208/111 |
| 4,002,557 | 1/1977 | Owen et al. | 208/111 |

*Primary Examiner*—Delbert E. Gantz
*Assistant Examiner*—Joan Thierstein
*Attorney, Agent, or Firm*—Charles A. Huggett; Carl D. Farnsworth

[57] ABSTRACT

Solvent refined coal bottoms which are solid at room temperature are converted to distillable liquids by blending the bottoms with recycle solvent and contacting the mixture in the presence of hydrogen over Ni/ZSM-5 catalyst.

18 Claims, No Drawings

CONVERSION OF COAL-DERIVED LIQUIDS WITH A CRYSTALLINE ALUMINOSILICATE ZEOLITE CATALYST

BACKGROUND OF THE INVENTION

1. Field of the Invention

This invention relates to an improved catalytic hydrogenation process for the conversion or upgrading of carbonaceous materials that are substantially solid at room temperature to hydrogen-enriched hydrocarbonaceous liquid products and further relates to an improved solvent extraction process for making liquid fuels from coal. More particularly, this invention relates to an improved process for converting solvent refined coal bottoms to distillable liquids.

2. Description of the Prior Art

Solvent extraction processes for converting coal to clean liquid or solid fuels generally comprises the following steps:

(1) coal extraction;
(2) separation of extract from undissolved residue; and
(3) hydrogenation of the separated extract.

In the coal extraction step, coal is slurried in an organic solvent and heated, often in the presence of added molecular hydrogen, to a temperature sufficient to dissolve or liquefy most of the organic material in the coal. A wide variety of solvents are known in the art, including hydrogen donor solvents, non-hydrogen donor solvents, and mixtures thereof. The solvent employed may be obtained from a previous conversion of coal or may be a solvent generated externally of the solvent extraction process or may be mixtures thereof. Thus, the solvent may be the liquid wherein the liquid product obtained by solvent extraction is dissolved as well as the liquid in which the undissolved solids from the coal extraction are dispersed.

After extraction, solids that are present may be removed from the product stream. The product stream, separated from undissolved residue, may then be stripped of solvent and the solvent recycled to the extraction step. The remaining extract, which will herein be referred to as "solvent refined coal," is a solid at room temperature and contains very little (generally less than about 10 weight percent) material boiling below 850° F. The solvent refined coal (which may still contain some "solvent") may thereafter be subjected to distillation to obtain products of various boiling ranges, some of which are useful as fuels. These fractions may then be further treated by refining processes including coking, hydrogenation, cracking, hydrocracking, hydrotreating, and the like.

Alternatively, the product stream containing the solvent refined coal may be subjected to further treatment without first removing the solvent. It is known that such processing schemes have the advantage of treating an easier-to-handle material than those in which the solvent is separated before further treatment. Again, the mixture containing solvent refined coal may be further treated by fractionation, coking, hydrogenation, cracking, hydrocracking, and the like.

Generally, further treatment of the separated coal extract may be described as hydrogenation, as has been noted above. Hydrogenation of coal extract or solvent refined coal usually occurs in three steps (see U.S. Pat. No. 3,523,886, for example):

(1) primary catalytic hydrocracking of extract to produce high boiling distillable liquids;
(2) catalytic hydrofining or hydrotreating of the high boiling distillable liquids, and
(3) secondary catalytic hydrocracking of the hydrofined high boiling distillate liquids to produce liquid fuels.

The function of the primary catalytic hydrocracking zone is to convert at least a portion of the nondistillable coal extract or solvent refined coal to an ash-free, distillable hydrocarbonaceous liquid boiling below about 750° to 950° F. However, the catalytic hydrogenation conditions are not sufficiently severe to yield a distillable product which is free of heteroatomic nitrogen, oxygen, and sulfur compounds or to yield a distillable product of which major portion boils in the gasoline boiling range. The function of the catalytic hydrofining or hydrotreating zone is to remove substantially all of the heteroatomic contaminants from all or the lower boiling fractions of the ash-free, distillable hydrocarbonaceous liquids. The function of the secondary catalytic hydrocracking zone is to lower the boiling range of at least the higher boiling fraction of the hydrofiner effluent to produce a liquid boiling in the gasoline boiling range.

Treatment of the higher boiling fractions of solvent refined coal and the undissolved residue often includes a carbonization or thermal cracking step. For example, U.S. Pat. No. 3,143,489 teaches a solvent extraction process wherein coal is slurried in an extraction zone with a suitable solvent to effect partial conversion of the coal, the liquid extract is separated from the undissolved residue, the residue is further processed in a carbonization zone, and the liquid products are subjected to catalytic hydrogenation in succeeding zones. (See also U.S. Pat. No. 3,523,886.)

U.S. Pat. No. 3,518,182 discloses a process wherein coal is solvent extracted in the presence of hydrogen, the extract (or the hydrovisbreaker effluent, as it is referred to in the '182 specification) is fractionated, and the various fractions are subjected to subsequent coking or hydrogenation steps to produce motor fuels from coal with the object of minimizing hydrogen consumption. More particularly, '182 teaches fractionating the solvent refined coal/solvent mixture and treating the respective fractions as follows:

(1) separating light gases containing hydrogen, $CO_2$, $H_2S$, $NH_3$, and light, $C_2$–$C_4$ hydrocarbons;
(2) separating a $C_5$- 300° F cut and hydroconverting it in a hydrotreater;
(3) separating a 300°–750° F gas oil cut and hydroconverting it by treatment in a hydrotreater followed by further treatment in a hydrocracker;
(4) separating a 750°–1050° F heavy gas oil cut and hydroconverting it in a hydrocracker; and
(5) separating a 1050° F bottoms cut containing ash, heavy hydrogen-deficient carbonaceous material, and very-difficult-to-extract nonhydrogen-deficient hydrocarbons, and coking it in the presence of a hydrogen-donor gas oil derived from the hydrocracked heavy gas oil cut (item 4, supra).

A process similar to that of '182 is disclosed in U.S. Pat. No. 3,607,718, the primary difference residing in the fact that '718 teaches removal of undissolved residue prior to fractionation of the solvent refined coal/solvent mixture and further teaches direct recycling of a 950° F+ bottoms fraction to the coal extraction step.

Catalytic hydrogenation of the higher boiling fractions and the undissolved residue is also known in the art. For example, U.S. Pat. No. 3,488,279 discloses a solvent extraction process wherein coal is first extracted by a hydrogen-donor solvent, at least a portion of the solvent and the liquid products of the hydrogen-donor extraction is then separated from the undissolved residue, and the residue is further treated in a catalytic hydrogenation zone. The combined liquid products from the hydrogen-donor extraction and the catalytic hydrogenation step are then distilled to yield the following fractions:

(1) a 450°-600° F naphtha and heating oil fraction;
(2) a 600°-950° F heavy gas oil fraction which is employed in it as recycle solvent, the remainder of which is further treated in a catalytic hydrocracking zone; and
(3) a 950° F+ heavy vacuum bottoms fraction which is either employed directly as fuel or catalytically hydrocracked.

A problem encountered in the hydrogenation of solvent refined coal is the viscous nature of the coal extract, particularly the heavier fractions of solvent refined coal which contains a principal portion of the total coal extract. Catalytic hydrogenation is even more difficult because sufficient catalyst/reactant contact is not easily obtained. The use of carrier solvents to enhance the flowability of the solvent refined coal and thereby enhance catalyst/reactant contact is known. However, the prior art processes do not selectively treat the heavier solvent refined coal fractions. Therefore, excessive cracking of the carrier solvent occurs. Not only does this reaction produce less valuable materials, but it also causes excessive hydrogen consumption. Accordingly, an improved method of converting higher-boiling fractions of solvent refined coal to distillable or pumpable liquids is needed.

SUMMARY OF THE INVENTION

The present invention resides in the discovery that solvent refined coal bottoms may be effectively and efficiently converted into distillable hydrocarbonaceous liquids by hydrogenation over Ni/ZSM-5 catalysts. The employment of this special zeolite catalyst results in a very desirable product distribution in that the catalytically hydrogenated product contains relatively large amounts of liquid hydrocarbons boiling in the gasoline range or higher and as little as possible of hydrocarbons boiling below butane. Lower boiling hydrocarbons such as methane and ethane are not only materials with small market value, but they are so rich in hydrogen that substantial quantities of the hydrogen fed to the process are consumed in saturating fragments of cracked molecules containing one to three carbon atoms.

Processing solvent refined coal bottoms blended with recycle solvent in the ratio from about 3:1 to 1:5 over Ni/ZSM-5 catalyst in the presence of hydrogen produces a liquid which flows freely at room temperature. A fraction representing 25 percent or more of the solvent refined coal is converted to distillable liquids with an unexpectedly low hydrogen consumption, indicating that the catalyst selectively treats the heavier solvent refined coal rather than the lighter recycle solvent. Furthermore, the improvement in fluidity of the refined coal and the conversion of solvent refined coal is achieved without excessive coking or hydrogen consumption. In contrast, conventional hydrogenative upgrading processes consume large amounts of hydrogen to achieve similar conversions, and non-hydrogenative processes make large amounts of coke.

DETAILED DESCRIPTION OF THE INVENTION

The term "solvent refined coal bottoms" as used herein refers to that fraction of solvent refined coal boiling above about 700° to 1000° F, and preferably above about 850° F. "Solvent refined coal" is the product of the coal extraction step (less solvent) of any known solvent extraction process for converting coal to clean liquid or solid fuels. The term "solvent" includes any of the wide variety of solvents known in the art of solvent extraction of coal, i.e., hydrogen-donor solvents, non-hydrogen-donor solvents, and mixtures thereof. The term "recycle solvent" refers to coal-derived solvents obtained from a previous conversion of coal as well as to other make-up solvents which are recovered from a previous conversion of coal.

The special zeolite catalysts employed in the present invention are members of a special class of zeolites exhibiting some unusual properties. These zeolites induce profound transformations of aliphatic hydrocarbons to aromatic hydrocarbons in commercially desirable yields and are generally highly effective in alkylation, isomerization, disproportionation and other reactions involving aromatic hydrocarbons. Although they have unusually low alumina contents, i.e. high silica to alumina ratios, they are very active even with silica to alumina ratios exceeding 30. This activity is surprising since catalytic activity of zeolites is generally attributed to framework aluminum atoms and cations associated with these aluminum atoms. These zeolites retain their crystallinity for long periods in spite of the presence of steam even at high temperatures which induce irreversible collapse of the crystal framework of other zeolites, e.g. of the X and A type. Furthermore, carbonaceous deposits, when formed, may be removed by burning at higher than usual temperatures to restore activity. In many environments, the zeolites of this class exhibit very low coke forming capability, conducive to very long times on stream between burning regenerations.

An important characteristic of the crystal structure of this class of zeolites is that it provides constrained access to, and egress from, the intra-crystalline free space by virtue of having a pore dimension greater than about 5 Angstroms and pore windows of about a size such as would be provided by 10-membered rings of oxygen atoms. It is to be understood, of course, that these rings are those formed by the regular disposition of the tetrahedra making up the anionic framework of the crystalline aluminosilicate, the oxygen atoms themselves being bonded to the silicon or aluminum atoms at the centers of the tetrahedra. Briefly, the preferred zeolites useful as catalysts in this invention possess, in combination: a silica to alumina ratio of at least about 12; and a structure providing constrained access to the crystalline free space.

The silica to alumina ratio referred to may be determined by conventional analysis. This ratio is meant to represent, as closely as possible, the ratio in the rigid anionic framework of the zeolite crystal and to exclude aluminum in the binder or in cationic or other form within the channels. Although zeolites with a silica to alumina ratio of at least 12 are useful, it is preferred to use zeolites having higher ratios of at least about 30. Such zeolites, after activation, acquire an intracrystalline sorption capacity for normal hexane which is greater than that for water, i.e. they exhibit "hydrophobic" properties. It is believed that this hydrophobic character is advantageous in the present invention.

The zeolites useful as catalysts in this invention freely sorb normal hexane and have a pore dimension greater than about 5 Angstroms. In addition, their structure must provide constrained access to some larger molecules. It is sometimes possible to judge from a known crystal structure whether such constrained access exists. For example, if the only pore windows in a crystal are formed by 8-membered rings of oxygen atoms, then access by molecules of larger cross-section than normal hexane is substantially excluded and the zeolite is not of the desired type. Zeolites with windows of 10-membered rings are preferred, although excessive puckering or pore blockage may render these zeolites substantially ineffective. Zeolites with windows of 12-membered rings do not generally appear to offer sufficient constraint to produce the advantageous conversions desired in the instant invention, although structures can be conceived, due to pore blockage or other cause, that may be operative.

Rather than attempt to judge from crystal structure whether or not a zeolite possesses the necessary constrained access, a simple determination of the "constraint index" may by made by continuously passing a mixture of equal weight of normal hexane and 3-methylpentane over a small sample, approximately 1 gram or less, of zeolite at atmospheric pressure according to the following procedure. A sample of the zeolite, in the form of pellets or extrudate, is crushed to a particle size about that of coarse sand and mounted in a glass tube. Prior to testing, the zeolite is treated with a stream of air at 1000° F for at least 15 minutes. The zeolite is then flushed with helium and the temperature adjusted between 550° F and 950° F to give an overall conversion between 10 percent and 60 percent. The mixture of hydrocarbons is passed at 1 liquid hourly space velocity (i.e., 1 volume of liquid hydrocarbon per volume of catalyst per hour) over the zeolite with a helium dilution to give a helium to total hydrocarbon mole ratio of 4:1. After 20 minutes on stream, a sample of the effluent is taken and analyzed, most conveniently by gas chromatography, to determine the fraction remaining unchanged for each of the two hydrocarbons.

The "constraint index" is calculated as follows:

$$\text{Constraint Index} = \frac{\log_{10}\ (\text{fraction of n-hexane remaining})}{\log_{10}\ (\text{fraction of 3-methylpentane remaining})}$$

The constraint index approximates the ratio of the cracking rate constants for the two hydrocarbons. Catalysts suitable for the present invention are those which employ a zeolite having a constraint index from 1.0 to 12.0. Constraint Index (CI) values for some typical zeolites including some not within the scope of this invention are:

| CAS | C.I. |
|---|---|
| ZSM-5 | 8.3 |
| ZSM-11 | 8.7 |
| ZSM-35 | 4.5 |
| TMA Offretite | 3.7 |
| ZSM-12 | 2 |
| ZSM-38 | 2 |
| Beta | 0.6 |
| ZSM-4 | 0.5 |

-continued

| CAS | C.I. |
|---|---|
| Acid Mordenite | 0.5 |
| REY | 0.4 |
| Amorphous Silica-alumina | 0.6 |
| Erionite | 38 |

The above-described Constraint Index is an important and even critical, definition of those zeolites which are useful to catalyze the instant process. The very nature of this parameter and the recited technique by which it is determined, however, admit of the possiblity that a given zeolite can be tested under somewhat different conditions and thereby have different constraint indexes. Constraint Index seems to vary somewhat with severity of operation (conversion). Therefore, it will be appreciated that it may be possible to so select test conditions to establish multiple constraint indexes for a particular given zeolite which may be both inside and outside the above-defined range of 1 to 12.

Thus, it should be understood that the "Constraint Index" value as used herein is an inclusive rather than an exclusive value. That is, a zeolite when tested by any combination of conditions within the testing definition set forth herein above to have a constraint index of 1 to 12 is intended to be included in the instant catalyst definition regardless that the same identical zeolite tested under other defined conditions may give a constraint index value outside of 1 to 12.

The class of zeolites defined herein is exemplified by ZSM-5, ZSM-11, ZSM-12, ZSM-21, ZSM-35, ZSM-38 and other similar material. Recently issued U.S. Pat. No. 3,702,886 describing and claiming ZSM-5 is incorporated herein by reference.

ZSM-11 is more particularly described in U.S. Pat. No. 3,709,979, the entire contents of which are incorporated herein by reference.

ZSM-12 is more particularly described in U.S. Pat. No. 3,832,449, the entire contents of which are incorporated herein by reference.

U.S. patent application Ser. No. 358,192, filed May 7, 1973, the entire contents of which are incorporated herein by reference, describes a zeolite composition, and a method of making such, designated as ZSM-21 which is useful in this invention.

U.S. patent application Ser. No. 528,061, filed Nov. 29, 1974, the entire contents of which are incorporated herein by reference, describes a zeolite composition including a method of making it. This composition is designated ZSM-35 and is useful in this invention.

U.S. patent application Ser. No. 528,060, filed Nov. 29, 1974, the entire contents of which are incorporated herein by reference, describes a zeolite composition including a method of making it. This composition is designated ZSM-38 and is useful in this invention.

The X-ray diffraction pattern of ZSM-21 appears to be generic to that of ZSM-35 and ZSM-38. Either or all of these zeolites is considered to be within the scope of this invention.

The specific zeolites described, when prepared in the presence of organic cations, are substantially catalytically inactive, possibly because the intracrystalline-free space is occupied by organic cations from the forming solution. They may be activated by heating in an inert atmosphere at 1000° F for 1 hour, for example, followed by base exchange with ammonium salts followed by calcination at 1000° F in air. The presence of organic cations in the forming solution may not be absolutely essential to the formation of this special type zeolite; however, the presence of these cations does appear to favor the formation of this special type of zeolite. More generally, it is desirable to activate this type zeolite by base exchange with ammonium salts followed by calcination in air at about 1000° F for from about 15 minutes to about 24 hours.

Natural zeolites may sometimes be converted to this type zeolite by various activation procedures and other treatments such as base exchange, steaming, alumina extraction and calcination, alone or in combinations. Natural minerals which may be so treated include ferrierite, brewsterite, stilbite, dachiardite, epistilbite, heulandite and clinoptilolite. The preferred crystalline aluminosilicates are ZSM-5, ZSM-11, ZSM-12, and ZSM-21, with ZSM-5 particularly preferred.

The zeolites used as catalysts in this invention may be in the hydrogen form or they may be base exchanged or impregnated to contain ammonium or a metal cation complement. It is desirable to calcine the zeolite after base exchange. The metal cations that may be present include any of the cations of the metals of Groups I through VIII of the periodic table. However, in the case of Group IA metals, the cation content should in no case be so large as to substantially eliminate the activity of the zeolite for the catalysis being employed in the instant invention. For example, a completely sodium exchanged ZSM-5 appears to be largely inactive for shape selective conversions required in the present invention.

In a preferred aspect of this invention, the zeolites useful as catalysts herein are selected as those having a crystal framework density, in the dry hydrogen form, of not substantially below about 1.6 grams per cubic centimeter. It has been found that zeolites which satisfy all three of these criteria are most desired. Therefore, the preferred catalysts of this invention are those comprising zeolites having a constraint index as defined above about 1 to 12, a silica to alumina ratio of at least about 12 and a dried crystal density of not substantially less than about 1.6 grams per cubic centimeter. The dry density for known structures may be calculated from the number of silicon plus aluminum atoms per 1000 cubic Angstroms, as given, e.g., on page 19 of the article on Zeolite Structure by W. M. Meier. This paper, the entire contents of which are incorporated herein by reference, is included in "Proceedings of the Conference on Molecular Sieves, London, April, 1967" published by the Society of Chemical Industry, London, 1968. When the crystal structure is unknown, the crystal framework density may be determined by classical pyknometer techniques. For example, it may be determined by immersing the dry hydrogen form of the zeolite in an organic solvent which is not sorbed by the crystal. It is possible that the unusual sustained activity and stability of this class of zeolites is associated with its high crystal anionic framework density of not less than about 1.6 grams per cubic centimeter. This high density, of course, must be associated with a relatively small amount of free space within the crystal, which might be expected to result in more stable structures. This free space, however, seems to be important as the locus of catalytic activity.

Crystal framework densities of some typical zeolites including some which are not within the purview of this invention are:

| Zeolite | Void Volume | Framework Density |
|---|---|---|
| Ferrierite | 0.28 cc/cc | 1.76 g/cc |
| Mordenite | .28 | 1.7 |
| ZSM-5, -11 | .29 | 1.79 |
| Dachiardite | .32 | 1.72 |
| L | .32 | 1.61 |
| Clinoptilolite | .34 | 1.71 |
| Laumontite | .34 | 1.77 |
| ZSM-4 (Omega) | .38 | 1.65 |
| Heulandite | .39 | 1.69 |
| P | .41 | 1.57 |
| Offretite | .40 | 1.55 |
| Levynite | .40 | 1.54 |
| Erionite | .35 | 1.51 |
| Gmelinite | .44 | 1.46 |
| Chabazite | .47 | 1.45 |
| A | .5 | 1.3 |
| Y | .48 | 1.27 |

A particularly preferred embodiment of the novel process of this invention resides in having a hydrogenation material associated with the crystalline aluminosilicate zeolite. In this connection, it has been found that the presence of a hydrogenation metal prolongs catalyst life and leads to more efficient and desirable operation. A typical hydrogenation component would include tungsten, vanadium, molybdenum, rhenium, nickel, cobalt, chromium, manganese, platinum, palladium, etc. including compounds thereof.

The manner in which the hydrogenation component is associated with the zeolite is open. It can be base exchanged into the zeolite or impregnated therein or physically intimately admixed therewith. The most preferred catalyst for carrying out the novel process of this invention is a nickel and acid exchanged ZSM-5 which is admixed with about 30–35 percent by weight of an alumina binder. After the ZSM-5 zeolite and an alumina binder are mixed, the mixture is exchanged with nickel in one catalyst preparation.

As has heretofore been stated, the most preferred form of the specific, previously defined zeolites in carrying out the novel process of this invention is the hydrogen form. As is well known in the art, the hydrogen form can be made by base exchanging the particular zeolite with hydrogen ions or ions capable of conversion to hydrogen ions, i.e., ammonium ions.

The crystalline zeolitic compositions can also be admixed with a non-acidic inorganic binder, such as alumina in order to impart the desired properties to the zeolite, such as increased strength and attrition resistance. Quite obviously, the proportion of binder employed is not narrowly critical, and it has been found convenient to use compositions where the binder is present from about 10 to 70 percent and preferably 30–40 percent based on the total weight of zeolite plus binder.

The novel process of this invention is carried out by contacting solvent refined coal bottoms blended with recycle solvent in the ratio within the range of about 3:1 to 1:5 bottoms to solvent with Ni/ZSM-5 catalyst in the presence of hydrogen under the following conditions:

(1) reactor temperature — 700° to 850° F;
(2) reactor pressure (total pressure) — 300 to 3000 psig;
(3) hydrogen feed rate — 200 to 2000 s.c.f./bbl feed;
(4) hydrogen recycle rate — 1000 to 10,000 s.c.f./bbl feed, and
(5) liquid hourly space velocity (individual stage) — 0.1 to 2.0 volume/volume/hour.

A recycle solvent which is preferably employed in the process of the present invention is a solvent boiling between about 350° to 850° F which is recovered from the coal liquefaction product and which has not been subjected to hydrogenation subsequent to recovery thereof. The ratio of solvent refined coal bottoms to recycle solvent is not narrowly critical, but the blended mixture should be sufficiently pumpable to allow easy handling and to allow the solvent refined coal bottoms to more easily fit into the pores of the hydroprocessing catalysts of this invention, thereby requiring less severe reaction conditions than if the solvent refined coal bottoms were treated in the absence of solvent. However, an excessive amount of solvent is undesirable in that added energy or work is required for subsequent separation of the solvent from the system. It is further apparent that a suitable blend of solvent refined coal bottoms and recycle solvent may be obtained by simply processing a 350° F+ fraction of the product from a coal extraction step according to the process of this invention.

The catalyst may be disposed in a fixed stationary bed, or various moving bed or ebulated bed techniques may be used. Generally, the ebulated bed technique is most satisfactory.

"Solvent refined coal" has been defined above as the product of the coal extraction step (less solvent) of any known solvent extraction process for converting coal to clean liquid or solid fuels. Furthermore, it has been noted that the term normally refers to the coal extraction product after separation from undissolved residue. Although the process of the present invention is more advantageously employed in the conversion of the bottoms fraction of solvent refined coal which has undergone a prior separation from undissolved residue, the full scope of this invention is not so limited. Thus, treatment of a solvent refined coal fraction boiling above about 700° F to 1000° F and containing ash, heavy hydrogen-deficient carbonaceous material, and very difficult-to-extract nonhydrogen-deficient hydrocarbons is also within the scope of this invention.

In the particular embodiment of this invention wherein the solvent refined coal has been separated from undissolved residue, it may also be desirable to deash the solvent refined coal or the solvent refined coal bottoms prior to conversion over Ni/ZSM-5 catalyst. Various deashing methods are known in the prior art — any of which may be employed: e.g., acid washing, catalyst abrasion, alkaline ash removal, and precipatating solvent techniques, filtration, centrifugation. (See. U.S. Pat. Nos. 3,232,861 and 3,791,956.)

The following examples illustrate the best mode now contemplated for carrying out the invention.

EXAMPLES 1-3

A 1:1 mixture of 850° F+solvent refined coal bottoms and 450°-850° F recycle solvent was processed in a shaker bomb at 2000 psig, and at temperatures of 600° F, 700° F, and 800° F in the presence of hydrogen and 25 weight percent of Ni/ZSM-5 catalyst. The results are summarized below in Table I.

TABLE I

| Run No. | SB-6236 | SB-6237 | SB-6238 |
|---|---|---|---|
| Temperature, ° F | 600 | 700 | 800 |
| Pressure, psig | 2000 | 2000 | 2000 |
| Ratio catalyst/oil (wt) | 0.25 | 0.25 | 0.25 |
| Reaction Time, Hrs. | 2 | 2 | 2 |
| Deoxygenation, wt.% | 15 | 0 | 41 |
| Desulfurization, wt.% | 8 | 20 | 39 |
| Denitrogenation, wt.% | 0 | 0 | 0 |

TABLE I-continued

| Run No. | SB-6236 | SB-6237 | SB-6238 |
|---|---|---|---|
| SCF/Barrel of SRC Hydrogen consumption | 300 | 888 | 1448 |
| Conversion of SRC to Distillable Products, Vol.% | 0.6 | 9.4 | 28.8 |
| Catalyst Charged, g. | 50.0 | 50.0 | 50.0 |
| Catalyst Revovered, g. | 59.5 | 57.3 | 63.1 |
| Coke Recovered | None | None | None |

Both conversion and hydrogen consumption increase with temperature-conversion increasing more rapidly than hydrogen consumption, indicating that the heavier materials are preferentially being treated. The product from the run at 600° F was solid at room temperature, the product from the run at 700° F was barely fluid, and the product from the run at 800° F was similar in fluidity to a heavy dewaxed gas oil at room temperature. The catalyst from all runs was a relatively clean, gray color without any sign of coke deposits.

What is claimed is:

1. An improved process for making liquid fuels from coal which comprises contacting a mixture of solvent refined coal bottoms with a solvent selected from the group consisting of coal-derived solvents obtained from a previous conversion of coal, make-up solvents recovered from a previous conversion of coal, and mixtures thereof at a temperature of from about 700° to 850° F, at a pressure of from 300 to 3000 psig, and in the presence of added hydrogen with a crystalline aluminosilicate zeolite having a pore dimension greater than about 5 Angstroms, a constraint index from about 1 to 12 and a silica to alumina ratio of at least about 12 which has a hydrogenation metal associated therewith and recovering therefrom a liquid which flows freely at room temperature.

2. The process of claim 1 wherein the solvent refined coal bottoms have been previously separated from undissolved residue.

3. The process of claim 2 wherein the solvent refined coal bottoms have been previously deashed.

4. A process for converting solvent refined coal bottoms to distillable liquids which comprises blending the bottoms with a solvent from the coal extraction step of a solvent extraction process for making liquid fuels from coal in the ratio of from 3:1 to 1:5 and contacting the blend at a temperature of from about 700° to 850° F, at a pressure of from 300 to 3000 psig, and in the presence of added hydrogen with a crystalline aluminosilicate zeolite having a pore dimension greater than about 5 Angstroms, a constraint index from about 1 to 12 and a silica to alumina ratio of at least about 12 which has a hydrogenation metal associated therewith.

5. In a solvent extraction process for making liquid fuels from coal which includes the steps of (a) coal extraction, (b) separation of extract from undissolved residue, (c) deashing of extract, (d) catalytic hydrogenation of the deashed extract, and (e) hydrotreating of the hydrogenated coal extract, an improved catalytic hydrogenation step which comprises: separating an 850° F+ solvent refined coal bottoms fraction from the deashed extract; blending the bottoms fraction with a solvent selected from the group consisting of coal derived solvents obtained from a previous conversion of coal, make up solvents recovered from a previous conversion of coal, and mixtures thereof in the ratio of from 3:1 to 1:5; contacting the blend at a temperature of from 700° F to 850° F, at a pressure of from 300 to 3000 psig, and in the presence of added hydrogen with a crystalline aluminosilicate zeolite having a pore dimension greater than about 5 Angstroms, a constraint index from about 1 to 12 and a silica to alumina ratio of at least about 12 which has a hydrogenation metal associated therewith; and recovering a distillable, hydrogenated coal extract.

6. The process of claim 1 wherein the hydrogenation metal associated with the crystalline aluminosilicate zeolite is nickel.

7. The process of claim 4 wherein the hydrogenation metal associated with the crystalline aluminosilicate zeolite is nickel.

8. The process of claim 5 wherein the hydrogenation metal assicated with the crystalline aluminosilicate zeolite is nickel.

9. The process of claim 1 wherein the crystalline aluminosilicate zeolite is ZSM-5 which is admixed with an inorganic binder.

10. The process of claim 4 wherein the crystalline aluminosilicate zeolite is ZSM-5 which is admixed with an inorganic binder.

11. The process of claim 9 wherein the binder is alumina.

12. The process of claim 11 wherein the mixture of solvent refined coal bottoms and recycle solvent is the 350° $F^+$ fraction of the product from the coal extraction step of a solvent extraction process for making liquid fuels from coal.

13. The process of claim 5 wherein the crystalline aluminosilicate zeolite is ZSM-5 which is admixed with an inorganic binder.

14. The process of claim 10 wherein the binder is alumina.

15. The process of claim 13 wherein the binder is alumina.

16. The process of claim 6 wherein the ZSM-5 crystalline aluminosilicate zeolite is in the hydrogen form.

17. The process of claim 7 wherein the ZSM-5 crystalline aluminosilicate zeolite is in the hydrogen form.

18. The process of claim 8 wherein the ZSM-5 crystalline aluminosilicate zeolite is in the hydrogen form.

* * * * *